US008397735B2

(12) United States Patent
Roederer et al.

(10) Patent No.: US 8,397,735 B2
(45) Date of Patent: Mar. 19, 2013

(54) DIRT SEPARATOR DEVICE WITH LEVEL CONTROL

(75) Inventors: Thomas Roederer, Hohberg (DE); Joachim Franz, Friesenheim (DE)

(73) Assignee: Meiko Maschinenbau GmbH & Co. KG, Offenburg (DE)

( * ) Notice: Subject to any disclaimer, the term of this patent is extended or adjusted under 35 U.S.C. 154(b) by 706 days.

(21) Appl. No.: 12/463,643

(22) Filed: May 11, 2009

(65) Prior Publication Data

US 2009/0277511 A1 Nov. 12, 2009

(30) Foreign Application Priority Data

May 9, 2008 (DE) ..... 10 2008 022 960

(51) Int. Cl.
*A47L 15/00* (2006.01)
*B08B 3/02* (2006.01)
*F04F 10/00* (2006.01)

(52) U.S. Cl. ..... 134/60; 134/61; 134/56 D; 137/132; 137/262; 137/577

(58) Field of Classification Search ..... 134/57 D, 134/57 DL, 56 D, 58 D, 58 DL, 25.2, 60, 134/61; 137/132, 262, 577
See application file for complete search history.

(56) References Cited

FOREIGN PATENT DOCUMENTS

| | | | | |
|---|---|---|---|---|
| DE | 6602300 | U | | 5/1969 |
| DE | 1 965 828 | A1 | | 5/1971 |
| DE | 1 703 612 | A1 | | 2/1972 |
| DE | 198 36 739 | A1 | | 2/2000 |
| DE | 19836739 | A1 | * | 2/2000 |
| DE | 10 2005 035 | A1 | | 2/2007 |
| GB | 1 068 541 | | | 5/1967 |
| GB | 1215129 | A | * | 12/1970 |

* cited by examiner

*Primary Examiner* — Michael Barr
*Assistant Examiner* — Caitlin N Dunlap
(74) *Attorney, Agent, or Firm* — Muncy, Geissler, Olds & Lowe, PLLC

(57) ABSTRACT

An apparatus for level control in a fluid tank is provided, wherein the fluid tank is designed to accommodate a supply of a fluid. The apparatus includes at least one conveying line through which the fluid can flow and which has at least one control opening which is hydraulically connected to the fluid tank. The control opening is designed to at least largely prevent fluid flowing out of the conveying line and into the fluid tank when at least one minimum level in the fluid tank is exceeded, and the control opening is further designed to allow fluid to flow out of the conveying line and into the fluid tank when the at least one minimum level in the fluid tank is undershot.

17 Claims, 2 Drawing Sheets

DIRT SEPARATOR DEVICE WITH LEVEL CONTROL

This nonprovisional application claims priority under 35 U.S.C. § 119(a) to German Patent Application No. 102008022960.1, which was filed in Germany on May 9, 2008, and which is herein incorporated by reference.

BACKGROUND OF THE INVENTION

1. Field of the Invention

The invention relates to an apparatus and to a method for level control in a fluid tank. Apparatuses and methods of this kind can be used, in particular, in cleaning appliances for cleaning washware. For example, the apparatus and the method can be used in dishwashers for dishes, containers or similar washware, in particular in dishwashers for commercial use. In addition to single-chamber dishwashers, the invention can advantageously be used in multi-chamber dishwashers too, for example in conveyor-type dishwashers. The invention can be used with particular preference in conjunction with treatment apparatuses for removing impurities from a cleaning liquid. For example, a treatment apparatus of this kind can comprise a device for separating dirt, preferably a centrifugal separator for separating impurities using centrifugal force.

2. Description of the Background Art

Cleaning apparatuses for cleaning washware are known from the extremely wide-ranging fields of natural sciences, engineering and medical technology. In the text which follows, reference is made to dishwashers in particular, but other types of cleaning appliances, for example cleaning appliances for cleaning medical equipment, articles for patient care, cleaning appliances for cleaning containers and trays or other types of cleaning apparatuses, can benefit from level control according to the invention. In general, the invention can also be used in other types of fluid systems in which level control of a fluid in a fluid tank is important.

The treatment of cleaning liquids, for example water with or without added assistants (for example detergents, rinse aids or the like) plays an important role in many cleaning apparatuses. Treatment apparatuses which are designed to remove impurities, for example liquid or solid impurities (for example suspended particles), from the cleaning liquid are often provided for this purpose. As an alternative or in addition to, for example, filters which can carry out the treatment operation, the technique of centrifugal separation is often used to treat cleaning liquids. Such dirt separators which are based on centrifugal separators are often also called "cyclones". Centrifugal separators of this kind can be used particularly advantageously in conjunction with dishwashers, as is known from DE 1 965 828 A1, DE 1 703 612 A1, DE 660 23 00 U, DE 198 36 739 A1 or DE 1 250 979 A1. In the text which follows, reference is made to all of these documents for possible refinements of a centrifugal separator and for functional principles of such centrifugal separators. Centrifugal separators are designed to make the cleaning liquid to be purified eddy, for example in the form of one or more vortices. By virtue of this eddying, impurities are separated off due to their inertia.

If a tank of a dishwasher, for example a washing tank, is equipped with (that is to say is connected to) a treatment apparatus of this kind, in particular a centrifugal separator, in order to clean the cleaning liquid continuously or in specific cycles, it is often necessary for a partial quantity of the cleaning liquid which is routed through the treatment apparatus to flow out of this treatment apparatus together with the separated dirt, for example as part of a circuit. However, this reduces the level of cleaning liquid in the associated supply tank. This loss should be permanently compensated for, so that the ability of the cleaning apparatus to function is maintained.

This level compensation can be performed in various ways. For example, a level sensor can be used to detect whether the level in the supply tank has fallen below a permissible quantity. If this is the case, a refilling system can be put into operation. However, this means increased outlay on equipment.

In another procedure, cleaning liquid flows, for example out of a downstream tank of the cleaning apparatus, into the supply tank, from which the treatment apparatus is fed, and supplements the filling level. However, if the quantity of water flowing in is not sufficient for operation- or method-related reasons, a circulation pump for cleaning and/or the circuit through the treatment apparatus, for example, has to be disconnected. This results in the disadvantage that there is no longer any cleaning function in the corresponding section of the cleaning apparatus in this case, or that the treatment of cleaning liquid is put out of operation.

A further disadvantage of the described procedures is that an increased quantity of cleaning liquid is consumed. For example, continuous refilling of water to maintain the function of the cleaning apparatus can be associated with increased water consumption. Although substantially no water is lost during the washing process in the apparatus described in DE 1 250 979 A1, this advantage has to come at the expense of additional complexity of a dirt-collection container at the waste-water outflow of the centrifugal separator and an additional stop valve at the outlet of this dirt-collection container.

Overall, the apparatuses known from the prior art therefore have the disadvantage that a considerable amount of additional outlay on a sensor system and additional apparatuses is required in order to control the liquid level in the supply tank, if any such control is provided at all, and this considerably increases the costs and the technical outlay on the cleaning apparatus overall. This also results in an increased susceptibility of the cleaning apparatuses to faults.

SUMMARY OF THE INVENTION

It is therefore an object of the present invention to provide an apparatus for level control in a fluid tank, which apparatus can be used, in particular, in a cleaning apparatus with a treatment apparatus, and which apparatus at least largely avoids the disadvantages of the above-described prior art. In particular, a high degree of functional reliability as regards level control and, at the same time, minimal outlay on a sensor system or other apparatuses should be ensured.

An embodiment of the invention provides an apparatus for level control in a fluid tank. The fluid tank is designed to accommodate a supply of a fluid, in particular a liquid. This liquid may be, for example, a cleaning liquid, in particular water with or without added assistants, for example detergents, rinse aids or similar assistants. The fluid tank may be configured, for example, as a pressureless fluid tank in which the fluid is accommodated up to one level.

The apparatus further comprises at least one conveying line through which the fluid can flow. The conveying line may be configured, for example, as a pipe with a rectangular, square or round cross section or a cross section of some other configuration. The dimensions of this conveying line can be matched to the requirements of the respective overall apparatus in which the apparatus for level control is used.

The conveying line can have at least one control opening which is hydraulically connected to the fluid tank. In this case, a hydraulic connection is understood to be a connection in which the fluid of the fluid tank can act on the control opening in a hydraulic manner in order to open and to close said control opening. In the process, the fluid preferably comes into direct contact with this control opening in order to open or to close said control opening. The hydraulic connection may be established, for example, by the control opening being arranged directly in the fluid tank or, as an alternative or in addition, being arranged in a control tank which is hydraulically connected to the fluid tank, for example a secondary tank. In this way, the same fluid level can be set, for example, in the control tank as in the actual fluid tank.

The control opening can be designed to at least largely prevent fluid flowing out of the conveying line and into the fluid tank when at least one minimum level in the fluid tank is exceeded. The control opening can further be designed to allow fluid to flow out of the conveying line and into the fluid tank when the at least one minimum level in the fluid tank is undershot. The control opening is preferably configured without any moving components in this case and can be opened and closed solely by being opened or unblocked by the fluid by means of the hydraulic connection. Level control in the supply tank is accordingly preferably performed automatically, that is to say without a sensor system and/or without moving components, so that a level in the supply tank can be kept at a predefined value, or so that the fluid can be prevented from falling below the at least one predefined minimum level. However, as an alternative or in addition, valves, floats or similar moving components or sensors which, for example, allow the at least one control opening to be opened and closed depending on the level in the fluid tank may nevertheless be provided.

In this way, the proposed apparatus can therefore be used to realize simple and cost-effective level control which is not sensitive to faults. The minimum level being undershot results in the control opening being unblocked, and fluid flowing out of the conveying line and into the fluid tank again raises or at least does not further reduce the level in the fluid tank.

The minimum level can be predefined, for example, by a position of the control opening, for example vertical positioning of the control opening. "Undershooting" and "exceeding" can cover a "<" or "≦" and, respectively, a ">" or "≧" relationship. Since the control opening has a physical extent in practice, the minimum level can also comprise a level range, within which the control opening is gradually unblocked or closed, instead of an infinitely small level limit.

Instead of a single control opening, it is also possible to predefine a plurality of control openings or a plurality of minimum levels. In this way, gradual level regulation can be performed by, for example, the individual control openings being unblocked or closed one after the other.

In an embodiment, the conveying line can have at least one control section which is arranged within the fluid tank or within a control tank which is hydraulically connected to the fluid tank. The control opening can be arranged in this control section. For example, the conveying line can run at least partially horizontally in the control section, wherein, for example, the control opening can be arranged in the horizontal region. However, another arrangement of the control opening is also possible. The control opening can be arranged, for example, on a lower face of the conveying line in the control section, for example in an at least horizontally running region of the control section.

As described above, the control opening can be configured as a purely mechanical rigid opening without moving components. For example, the control opening can be configured without any moving components and can have a specific shape and size which are particularly well suited to the respective use. By way of example, a rectangular, square, round or oval opening or an opening configured in some other way can be provided, for example an opening with a flow cross section which takes into account the respective flow conditions in the overall apparatus.

The apparatus can further comprise at least one conveying device, for example at least one pump. This conveying device should be designed to convey fluid out of the fluid tank and into the conveying line.

The present invention can be used, in particular and as described above, in conjunction with a cleaning apparatus for cleaning at least one item of washware, for example as a constituent part of one of the above-described cleaning apparatuses, for example a dishwasher, a cleaning machine for containers or similar washware. Use in commercial dishwashers, that is to say in dishwashers which have at least two tanks for accommodating cleaning liquid, is particularly preferred. Said invention can be used, for example, in single-chamber dishwashers and/or in conveyor-type dishwashers.

The cleaning apparatus can include at least one supply tank for accommodating a cleaning liquid. As described above, this supply tank can be configured as a pressureless or pressurized supply tank. Use in open supply tanks, that is to say supply tanks which have at least one opening, for example, in the direction of a cleaning chamber of the cleaning apparatus, that is to say can be subjected to the action of cleaning fluid from this cleaning chamber, is particularly preferred.

The cleaning apparatus can further include at least one apparatus for level control according to one or more of the above-described embodiments. According to the invention, this apparatus can be used to perform level control in the supply tank of the cleaning apparatus. The apparatus can have one or more associated supply tanks of this kind and, in particular, may be able to keep the level in the at least one supply tank at a predefined value without a sensor system or moving components or to prevent or slow down a minimum level of the cleaning liquid in the supply tank being undershot at least within predefined limits. In this sense, the term "level control" is to be understood within the scope of the present invention overall as meaning that, in addition to control in the actual sense, that is to say active adjustment to a setpoint value by virtue of corresponding compensation measures, said term can also cover undershooting of the at least one minimum level being prevented or slowed down.

The apparatus for level control can be designed, in particular, in the cleaning apparatus in such a way that the control opening is hydraulically connected to the supply tank, while one end of the conveying line is connected to a further tank of the cleaning apparatus, preferably a tank with a lower degree of purity, or an outflow system of the cleaning apparatus. The cleaning apparatus can comprise, in particular, at least two cleaning zones, wherein a transportation apparatus of the cleaning apparatus can ensure that the washware is transported through the at least two cleaning zones in a transportation direction. The supply tank can then have at least one first associated cleaning zone. The cleaning apparatus can be designed, in particular, to convey the cleaning liquid out of the supply tank and into the conveying line. A pump or a similar conveying device can, for example, be provided for this purpose, as has been described above. In this case, pumps can also be used synergistically, said pumps being present in the cleaning apparatus in any case, for example conveying pumps for supplying wash systems, spray nozzles or the like, or waste-water pumps. The further tank, in which the end of the conveying line of the apparatus for level control issues, should then preferably be a tank which has at least one associated second cleaning zone which is arranged upstream in the transportation direction. In this way, for example, overflowing of used cleaning liquid from a relatively clean cleaning zone into a cleaning zone with a lower degree of purity can be controlled via the conveying line in such a way that, at least within certain limits, overshooting of a minimum level in the relatively clean supply tank due to excessive amounts of fluid being conducted away into the upstream further tank can be prevented or at least slowed down.

In a further embodiment, which has already been described in the introduction, the cleaning apparatus can include at least one treatment apparatus for removing impurities from the cleaning liquid. This treatment apparatus can comprise, for example, at least one of the above-described devices, for example a filter or similar treatment apparatuses. However, for the reasons cited above, it is particularly preferred to use at least one centrifugal separator since the comparatively large liquid streams are generally required in such centrifugal separators in order to transport impurities away. The treatment device can be connected to the apparatus for level control, in particular to transport waste water away through the conveying line.

The treatment apparatus can therefore have at least one dirt outlet for conducting away a soiled fraction of the cleaning liquid, and at least one clean-liquid outlet for conducting away a cleaned fraction of the cleaning liquid. In particular, the dirt outlet can be connected to the conveying line. In contrast, the clean-liquid outlet can be arranged to allow the cleaned fraction to flow into the supply tank. By way of example, the treatment apparatus can further have a feed for supplying purified cleaning liquid, which feed is connected to the supply tank. Cleaning liquid can be conveyed out of the supply tank and to the feed by means of a pump, after which the purified fraction is returned to the supply tank, whereas the soiled fraction is transported away through the conveying line.

The cleaning apparatus can, for example, have at least one wash system for subjecting the washware to the action of the cleaning fluid, in particular at least one nozzle system. This wash system can be supplied with wash liquid from the supply tank via a wash line, wherein the feed of the treatment apparatus can be connected to the wash line. In this way, the purified fraction which is supplied to the feed of the treatment apparatus can be diverted away out of the wash line.

The apparatus for level control and the corresponding method and the cleaning apparatus have numerous advantages over known apparatuses and methods and permit novel, advantageous embodiments of level control arrangements. For example, the conveying line can be configured as a tubular waste-water line of the treatment apparatus, in particular of the centrifugal separator, and can be routed horizontally through the supply tank, for example via a specific section, said conveying line then forming the control section or a part of the control section. This control section can then be arranged, for example, at a predefined minimum height of the filling level of the supply tank, for example a dishwasher tank. Further on, the conveying line can then be guided out of the tank region of the supply tank. In this way, it is possible, for example, for the waste water, that is to say cleaning fluid containing a high proportion of dirt for example, to be conducted, in particular, into the dishwasher tank which is upstream in the transportation direction. However, as an alternative or in addition, the waste water can also be conducted directly into a waste-water connection of the machine, as part of an outflow system.

The horizontal line section can have the control opening of a specific size on its lower face. As long as the filling level in the supply tank is equal to or above the level of the control opening, the pressure of the cleaning fluid in the supply tank closes the opening, and waste water from the centrifugal separator can continue to flow in the direction of the waste-water pipe without obstruction. However, if the filling level in the supply tank falls below the predefined minimum level, the control opening on the lower face of the horizontal pipe section is unblocked. Starting from this point in time, waste water from the centrifugal separator can no longer flow in the direction of the outlet, but can fall back into the tank. This can prevent the liquid level in the supply tank dropping any further. Any such drop could result, for example, in a circulation pump of the corresponding supply tank, which feeds a wash system for example, being supplied with an insufficient quantity of cleaning liquid for long or short periods of time, as a result of which an entire section of the cleaning apparatus, for example the dishwasher, would be inoperative, for example.

During normal operation of the cleaning apparatus, a sufficient quantity of cleaning liquid, in particular water with or without assistants, can flow out of a downstream zone, for example out of a fresh-water rinse arrangement, to the described supply tank, so that the quantity of waste water which is required by the centrifugal separator can be compensated for. In specific operating states of the cleaning apparatus, for example in the case of special washware, water may be, as it is called, entrained, so that the quantity of water which flows in in a regular manner is not sufficient and therefore the desired minimum level in the supply tank would be undershot. This can be remedied by the inventive refinement of the apparatus and of the cleaning apparatus with minimum outlay.

The treatment apparatus can be specifically associated with the supply tank. In this way, it is possible, for example, to establish level control for the supply tank which is automatic and is able to keep the level in the supply tank at a predefined value without a sensor system or moving components.

The conveying line, which can be configured as a waste-water line for example, can be configured, for example, as a tubular conveying line and can have, for example, a circular, square or approximately square, rectangular or approximately rectangular cross section or another cross section. The control opening, which can be arranged on the lower face of the conveying line for example, can be matched to the size of the conveying line and/or to the volumetric flow rate prevailing during operation and can have, for example in the case of a pipe with an inside diameter of approximately 22 mm and a volumetric flow rate of approximately 80 l per minute, a length of approximately 20 mm and a width of approximately 20 mm too.

The described apparatus for level control in one or more of the above-described embodiments can be used, in principle, for any processes in which level control is required. Simple level control, preferably without a complex control system and/or sensor system, can be ensured in this way. This is particularly advantageously noticeable in said cleaning apparatuses, in particular in dishwashers. In the case of such dishwashers, the apparatus for level control can be used, for example, to also control other processes which make level control necessary. Therefore, entirely generally, wash liquid can be conveyed away out of a tank by a pump for example, and undershooting of a specific minimum level in the corresponding tank can be avoided.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
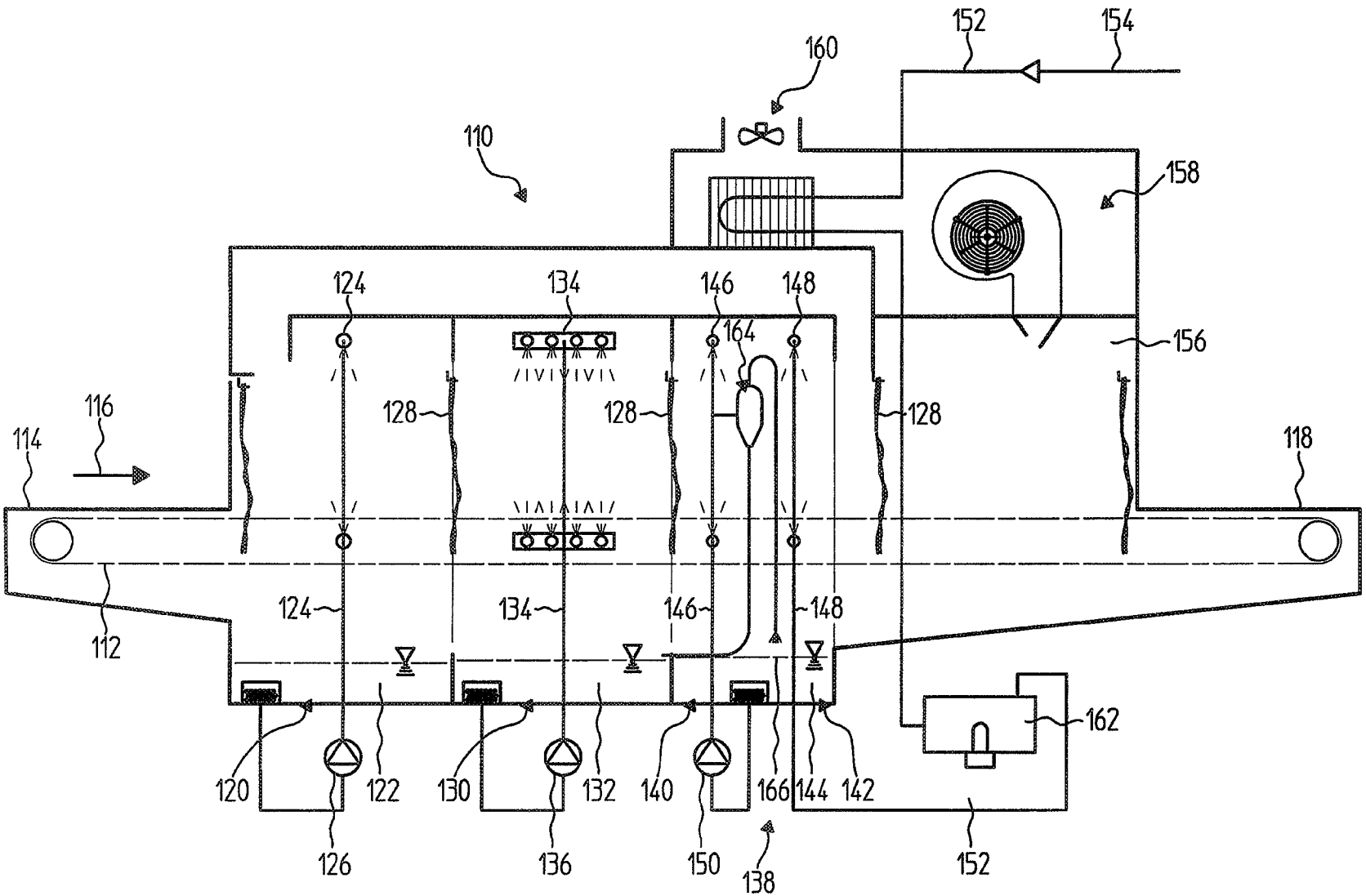
FIG. 1 shows a sectional illustration of a cleaning apparatus according to the invention with an apparatus for level control.

FIG. 1 illustrates one possible exemplary embodiment of a cleaning apparatus 110 according to the invention. In this exemplary embodiment, the cleaning apparatus 110 is configured as a conveyor-type dishwasher and has a transportation apparatus 112 for transporting the washware. The washware is placed on the transportation apparatus 112 at a charge point 114, for example directly or using racks, and is transported through the cleaning apparatus 110 in a transportation direction 116, in order to then be removed again, in the cleaned state, at a discharge point 118 at the outflow end of the cleaning apparatus 110.

In the illustrated exemplary embodiment, the cleaning apparatus 110 has a plurality of cleaning zones through which the washware is passed in succession. Therefore, a pre-wash zone 120 is provided and has a pre-wash tank 122 and a pre-wash system 124 which is fed from the pre-wash tank 122 by means of a pre-wash pump 126.

A main-wash zone 130 with a main-wash tank 132 and a main-wash system 134 which is fed from the main-wash tank 132 by means of a main-wash pump 136 is arranged downstream of the pre-wash zone 120 in the transportation direction 116 and is separated from said pre-wash zone optionally by a separating curtain 128.

A rinse zone 138 which is divided into a pump rinse zone 140 and a fresh-water rinse zone 142 is in turn connected downstream of the main-wash zone 130, in a manner separated by an optional separating curtain 128. The rinse zone 138 comprises a common rinse tank 144 and a pump rinse system 146 of the pump rinse zone 140 and also a fresh-water rinse system 148 of the fresh-water rinse zone 142. Whereas the pump rinse system 146 is fed with rinse liquid from the rinse tank 144 by means of a rinse pump 150, the fresh-water rinse system 148 is fed from a water feed 154 via a fresh-water line 152.

A drying zone 156 which can have, for example, a blower 158 and an exhaust-air apparatus 160 is connected downstream of the rinse zone 138 and is separated from said rinse zone again by an optional separating curtain 128. The fresh-water line 152 can be passed, for example, through the exhaust-air apparatus 160, for example a heat exchanger of this exhaust-air apparatus 160, and can further have a boiler 162 in order to bring the inflowing water to a temperature which is required for the rinsing process.

It should be noted that the cleaning apparatus 110 shown in FIG. 1 is to be understood merely by way of example and that other types of cleaning apparatuses can also be configured in a manner according to the invention. In particular, the cleaning apparatus 110 can be varied in terms of the type and configuration of the wash zones and the type and configuration of the wash systems. Completely different cleaning apparatus superstructures are also feasible, for example single-chamber systems or similar superstructures.

The cleaning apparatus 110 further comprises an apparatus 164 for level control which, in the illustrated exemplary embodiment, serves to control a level 166 in the rinse tank 144 and, at the same time, is used to treat the cleaning liquid in the rinse tank 144. However, it should be noted that this apparatus 164 for level control, with and without the function for treating cleaning liquid, can also be used, as an alternative or in addition, in other regions of the cleaning apparatus 110, for example in one or more of the other wash zones 120, 130, 138, 140, 142.

Figure 2:
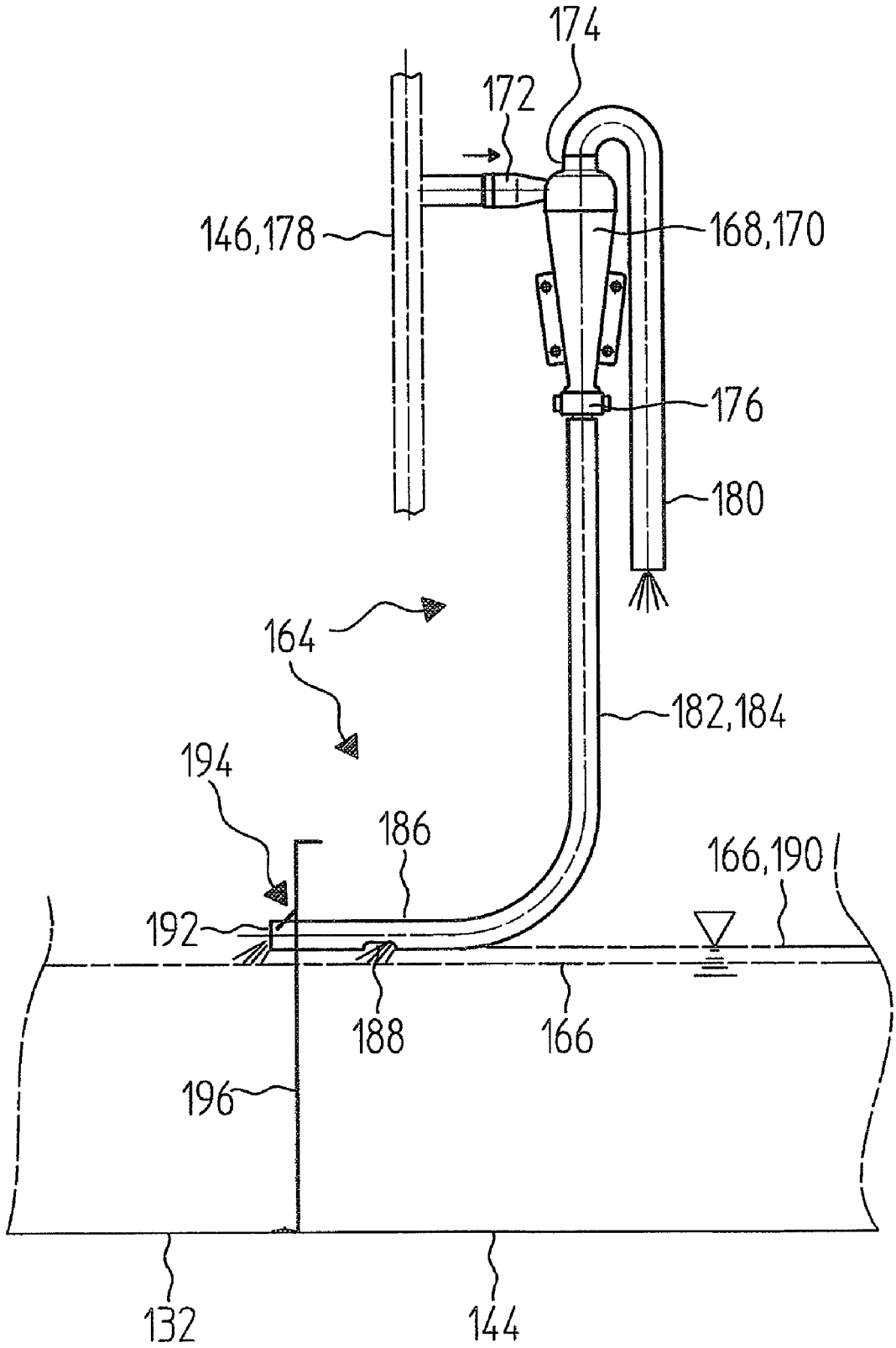
FIG. 2 shows a detailed illustration of the apparatus for level control.

FIG. 2 shows a detailed illustration of this apparatus 164 according to FIG. 1, and the structure and the manner of operation of this apparatus 164 will be explained with reference to said detailed illustration. However, this apparatus 164 can also be used in other types of apparatuses which require level control.

In the illustrated exemplary embodiment, the apparatus 164 comprises a treatment apparatus 168 for treating cleaning liquid from the rinse tank 144. In the illustrated exemplary embodiment, this treatment apparatus 168 is configured as a centrifugal separator 170 and comprises a feed 172 for supplying cleaning liquid which is to be purified, a clean-liquid outlet 174 for conducting away a cleaned fraction of the cleaning liquid, and a dirt outlet 176 for conducting away a soiled fraction of the cleaning liquid, that is to say a fraction which contains a concentration of impurities. For possible refinements of the structure of the centrifugal separator 170, reference may be made, for example, to the prior art documents cited in the introduction, and so these details are not discussed in the following description. However, as an alternative or in addition to the centrifugal separator 170, the treatment apparatus 168 can also comprise other types of treatment apparatuses, for example filters or similar apparatuses.

In the illustrated exemplary embodiment, the feed 172 of the treatment apparatus 168 is connected to the rinse tank 144 via a wash line 178 of the pump rinse system 146 and is therefore supplied with cleaning liquid as a secondary stream from the pump rinse system 146 by means of the rinse pump 150. The centrifugal separator 170 separates off suspended matter which accumulates in the cleaning liquid, and thus improves the washing result. The cleaned wash liquid, which emerges from the clean-liquid outlet 174, returns to the rinse tank 144 via an outflow 180, for example in free fall. In contrast, the second fraction of the centrifugal separator 170, which fraction has a concentration of dirt and emerges at the dirt outlet 176, is conducted, in the illustrated exemplary embodiment, into one of the wash zones which is connected upstream in the transportation direction 116, in this example into the main-wash tank 132 for example, via a conveying line 182 which can also serve as a waste-water line 184. However, as an alternative or in addition, it is also possible to introduce the waste water from the conveying line 182 at another point of the cleaning apparatus 110, for example in another of the illustrated tanks. It is also possible, again as an alternative or in addition, to introduce the waste water directly into a waste-water system of the cleaning apparatus 110 or into a waste-water system of the building. In the illustrated exemplary embodiment, only one zone of the cleaning apparatus 110 is further equipped with a centrifugal separator 170. This does not restrict the possible embodiments. It is also possible to equip a plurality of or all of the zones with such centrifugal separators 170, and similarly also only individual, other zones instead of the rinse zone 138 cited in the example. Furthermore, instead of an individual apparatus 164 or an individual centrifugal separator 170, it is also possible to use a plurality of such apparatuses 164 or a plurality of such centrifugal separators 170 or treatment apparatuses 168 for each wash zone.

Furthermore, level control by the apparatus 164 in the rinse tank 144 will be explained with reference to FIG. 2. Therefore, the conveying line 182 has a substantially horizontally running control section 186 which is hydraulically connected to the rinse tank 144 or some other supply tank, in which the level of the cleaning liquid is to be controlled, via a control opening 188. In the illustrated exemplary embodiment, the control opening 188 is arranged on the lower face of the conveying line 182 in the control section 186, and therefore is directed into the rinse tank 144. Reference numerals 166 indicate possible levels of the cleaning liquid in the rinse tank 144, wherein the upper of the illustrated levels 166 is level with the control opening 188 and therefore at the same time characterizes a minimum level 190 beneath which the level of the cleaning liquid in the rinse tank 144 should not fall if possible. This minimum level 190 can be adjusted, for example, by moving the conveying line 182 in the vertical direction. It goes without saying that levels other than the illustrated levels 166 in FIG. 2 are possible. In the illustrated exemplary embodiment, one end 192 of the conveying line 182 projects into the main-wash tank 132, which is connected upstream of the rinse tank 144, via an aperture 194 in a wall 196 between the tanks 132 and 144, and forms an outlet opening via which liquid can flow out of the waste-water line 184 and into this main-wash tank 182.

During operation of the apparatus 164, the centrifugal separator 170 is, as described above, supplied with a secondary stream from the pump rinse system 146. The cleaned fluid of the first fraction falls back into the rinse tank 144 via the outflow 180. The waste water from the centrifugal separator 170, which waste water has a concentration of dirt, is conducted, in the example, into the main-wash zone 130 via the waste-water line 184. The control section 186 of the tubular waste-water line 184 of the apparatus 164 runs at least partially horizontally through the rinse tank 144 at the predefined height of the minimum level 190.

Further on, this waste-water line 184 then leads out of the rinse tank 144 and conducts the waste water (cleaning fluid with a high proportion of dirt) into the preceding dishwasher tank for example, in this case the main-wash tank 132. The horizontal control section 186 with the control opening 188 of a predefined size defines the minimum level 190. As long as the filling level in the rinse tank 144 is at or above the level of the control opening 188, the waste water from the centrifugal separator 170 continues to flow in the direction of the end of the conveying line 192 without obstruction and emerges at this end 192. If, in contrast, the filling level in the rinse tank 144 falls below the predefined minimum level 190, for example in a manner caused by particular operating conditions such as water being entrained, the control opening 188 on the lower face of the horizontal control section 186 is unblocked. Starting from this point in time, the waste water no longer flows out of the centrifugal separator 170 in the direction of the end 192, but falls back into the rinse tank 144 through the control opening 188. This prevents the liquid level in the rinse tank 144 dropping further. If the liquid level in the rinse tank 144 is further supplemented by the water which flows in in a regular manner, for example from a downstream zone of the cleaning apparatus 110, the control opening 188 is closed again, and the waste-water stream from the centrifugal separator 170 again emerges at the outlet opening at the end 192 of the conveying line 182. The control opening 188 on the lower face of the control section 186, which is routed level with the minimum level 190, is preferably matched to the size of the pipe of the tubular control section 186 and/or to the volumetric flow rate prevailing during operation and, for example in the case of a pipe with an inside diameter of approximately 20 mm and a volumetric flow rate of approximately 80 l per minute, is approximately 20 mm long and approximately 20 mm wide.

By virtue of the example illustrated in FIG. 1, an apparatus 164 according to the invention for level control, in particular with a treatment apparatus 168 (with or without a centrifugal separator 170) can also be used on conveyor-type dishwashers which have fewer or more tanks than illustrated, or else on a single-tank dishwasher. The invention further describes, in conjunction with FIG. 2, that the control section 186 is arranged directly in the rinse tank 144 and is routed level with the minimum level 190. However, a design is also feasible in which the hydraulic connection between the rinse tank 144 and the control opening 188 or the control section 186 is established in a different way. For example, the hydraulic connection can be established in such a way that the control section 186 is not routed directly in the rinse tank 144 but in a separate control tank, for example in a secondary container which is hydraulically connected to the rinse tank 144.

In addition to the integration of a treatment apparatus 168 into the apparatus 164 for level control, the apparatus 164 can also be used for other processes in the cleaning apparatuses 110 in which wash fluid is conveyed away out of a tank, for example by a pump, and undershooting of a specific minimum level in the corresponding tank is to be prevented. Accordingly, the apparatus 164 can be advantageously used in conjunction with the treatment of cleaning liquid, but it can also be used in a profitable, cost-effective and simple manner for other types of level control too.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An apparatus for level control in a fluid tank, the fluid tank configured to accommodate a supply of a fluid, the apparatus comprising:

at least one conveying line with an outlet opening through which the fluid flows to a further tank and an out flow system, the conveying line comprising at least one control opening which is hydraulically connected to the fluid tank, wherein the at least one control opening is blocked by pressure of the fluid in the fluid tank when at least one minimum level in the fluid tank is exceeded and the blocked control opening prevents fluid from flowing out of the conveying line into the fluid tank, and wherein the control opening is unblocked when the at least one minimum level in the fluid tank is undershot and the unblocked control opening allows fluid to flow out of the conveying line and into the fluid tank.

2. The apparatus as claimed in claim 1, wherein the conveying line has at least one control section, which is arranged within the fluid tank or within a control tank that is hydraulically connected to the fluid tank, and wherein the control opening is arranged in the control section.

3. The apparatus as claimed in claim 2, wherein the conveying line runs at least partially horizontally in the control section.

4. The apparatus as claimed in claim 2, wherein the control opening is arranged on a lower face of the conveying line in the control section.

5. The apparatus as claimed in claim 1, wherein the control opening is configured as a mechanically rigid opening without moving components.

6. The apparatus as claimed in claim 1, further comprising at least one conveying device, wherein the conveying device is configured to convey fluid out of the fluid tank and into the conveying line.

7. The apparatus as claimed in claim 1, further comprising at least one pump, wherein the pump is configured to convey fluid out of the fluid tank and into the conveying line.

8. A cleaning apparatus for cleaning at least one item of washware, the cleaning apparatus comprising:

at least one supply tank for accommodating a cleaning liquid; and at least one device for controlling the level in the supply tank, the at least one device comprising:

at least one conveying line with an outlet opening through which the fluid flows to another tank and an outflow system, the conveying line comprising at least one control opening which is hydraulically connected to the supply tank, the control opening being configured to prevent fluid from flowing out of the conveying line and into the supply tank when at least one minimum level in the supply tank is exceeded, the control opening being configured to allow fluid to flow out of the conveying line and into the supply tank when the at least one minimum level in the fluid tank is undershot.

9. The cleaning apparatus as claimed in claim 8, wherein the cleaning apparatus comprises:

at least two cleaning zones;

at least one transportation apparatus for conveying the washware through the at least two cleaning zones in a transportation direction, wherein the supply tank has at least one associated first cleaning zone, wherein the cleaning apparatus is configured to convey the cleaning liquid out of the supply tank and into the conveying line, and wherein the further tank has at least one associated second cleaning zone that is connected upstream in the transportation direction.

10. The cleaning apparatus as claimed in claim 8, further comprising at least one treatment apparatus for removing impurities from the cleaning liquid, wherein the treatment apparatus is connected to the apparatus for level control.

11. The cleaning apparatus as claimed in claim 10, wherein the treatment apparatus has at least one dirt outlet for conducting away a soiled fraction of the cleaning liquid, and at least one clean-liquid outlet for conducting away a cleaned fraction of the cleaning liquid, wherein the dirt outlet is connected to the conveying line, and wherein the clean-liquid outlet is arranged to allow the cleaned fraction to flow into the supply tank.

12. The cleaning apparatus as claimed in claim 10, wherein the treatment apparatus has at least one feed for supplying cleaning liquid which is to be purified, wherein the feed is connected to the supply tank.

13. The cleaning apparatus as claimed in claim 12, wherein the cleaning apparatus has at least one wash system for subjecting the washware to the action of the cleaning liquid, wherein the wash system is subjectable to the action of cleaning liquid from the supply tank via a wash line, and wherein the feed is connected to the wash line.

14. The cleaning apparatus as claimed in claim 13, wherein the at least one wash system comprises a nozzle system.

15. The cleaning apparatus as claimed in claim 10, wherein the treatment apparatus has at least one centrifugal separator.

16. The cleaning apparatus as claimed in claim 8, wherein the conveying line comprises a discharge opening spaced from the at least one control opening in a downstream direction and wherein the discharge opening is positioned to discharge fluid outside the supply tank.

17. A cleaning apparatus, comprising:

a supply tank for accommodating a cleaning liquid; and a device for controlling a cleaning liquid level in the supply tank, the device comprising a conveying line through which the cleaning liquid can flow, the conveying line being disposed horizontally along the supply tank defining a height of a minimum cleaning liquid level in the supply tank, the conveying line comprising at least one control opening, disposed on a lower face of the conveying line and directed into the supply tank, wherein the control opening is blocked by pressure of the cleaning liquid in the supply tank when the minimum cleaning liquid level in the supply tank is exceeded and the blocked control opening prevents cleaning liquid from flowing out of the conveying line into the supply tank, and wherein the control opening is unblocked when the minimum cleaning liquid level in the supply tank is undershot and the unblocked control opening allows cleaning liquid to flow out of the conveying line and into the supply tank.

* * * * *